US010456324B2

(12) United States Patent
Greaves

(10) Patent No.: US 10,456,324 B2
(45) Date of Patent: Oct. 29, 2019

(54) SEX TOY WITH A PLURALITY OF SEPARATE HEAD PORTIONS

(71) Applicants: Charles Benjamin Delmage, Edmonton (CA); Jefferson Greaves, Winnipeg (CA)

(72) Inventor: Jefferson Greaves, Winnipeg (CA)

( * ) Notice: Subject to any disclaimer, the term of this patent is extended or adjusted under 35 U.S.C. 154(b) by 0 days.

(21) Appl. No.: 14/159,120

(22) Filed: Jan. 20, 2014

(65) Prior Publication Data

US 2014/0357943 A1 Dec. 4, 2014

Related U.S. Application Data

(60) Provisional application No. 61/830,900, filed on Jun. 4, 2013.

(51) Int. Cl.
*A61H 19/00* (2006.01)
*A61H 23/02* (2006.01)

(52) U.S. Cl.
CPC ..... *A61H 19/44* (2013.01); *A61H 23/02* (2013.01); *A61H 2201/165* (2013.01); *A61H 2201/1652* (2013.01); *A61H 2201/1685* (2013.01); *A61H 2201/1692* (2013.01)

(58) Field of Classification Search
CPC ..... A61H 19/44; A61H 2201/0153; A61H 19/32; A61H 19/00; A61H 2201/165; A61H 19/30; A61H 19/40; A61H 19/50; A61H 2201/1685
See application file for complete search history.

(56) References Cited

U.S. PATENT DOCUMENTS 7,513,868 B1 * 4/2009 Fontenot ..... 600/38
2008/0139980 A1 * 6/2008 Fladl et al. ..... 601/70

* cited by examiner

*Primary Examiner* — Christine H Matthews
(74) *Attorney, Agent, or Firm* — Adrain D. Battison; Ade: Company Inc; Michael R. Williams

(57) ABSTRACT

A sex toy includes a handle member forming a handle portion which can be manually grasped and held and/or can be strapped in place with an elongate connector portion at one end or both ends of the body together with a set of separate penetrative head portions each having an outer surface which is flexible and each having a receptacle therein for engaging onto the connector portion and a generally cylindrical penetrative portion arranged to extend forwardly from the handle member. The set of the head portions have different outside shapes and/or dimensions arranged such that each can be engaged separately onto the handle member when selected.

19 Claims, 16 Drawing Sheets

SEX TOY WITH A PLURALITY OF SEPARATE HEAD PORTIONS

This application claims the benefit under 35 USC 119(e) of Provisional Application 61/830,900 filed Jun. 4, 2013.

This invention relates to a sex toy of the type which can form a stationary dildo or a vibratory member with a plurality of separate penetrative head portions and handle portion.

It is one object of the invention to provide a sex toy with a plurality of separate penetrative head portions which can be adapted for different effects.

According to one aspect of the invention there is provided a sex toy comprising:

a handle member forming a body which can be manually grasped and held;

a connector portion at least at one end of the handle member;

and a plurality of separate penetrative head portions each having a connector thereon for engaging onto the connector portion of the handle member and a generally cylindrical penetrative portion arranged to extend forwardly from the handle member, the head portions having different outside shapes and/or dimensions;

the head portions being arranged such that each can be engaged separately onto the handle member when selected.

The sex toy can be arranged so that the handle member forms a stationary member for a dildo or the handle member includes a vibratory motor. The motor is powered typically by battery which can be rechargeable.

The sex toy can be arranged so that the handle member has a cylindrical portion which forms a continuation of the cylindrical portion of the head portion when attached, so that the handle portion is also shaped to be penetrative. Thus the handle portion and head portion are both generally cylindrical allowing penetrative action from either end. When of the vibrating type, both the handle and the core can vibrate.

Preferably the connector portion forms a shaft extending longitudinally along the head portion on which there is provided a fastener to hold the receptacle onto the connector portion. This can provide a stiffener or core for the head when formed of a resilient material such as silicone. However other arrangements can omit the core making the head more flexible.

The handle portion can include a double ended arrangement to attach a head at each end.

The different types of fastening system proposed herein can be used on any one of the different styles of head and handle combinations.

While the handle member and head members of a set are preferably formed from a flexible plastics or silicone material for flexibility, one or more of the set may be formed from other materials such as:

Metal,
Rubber or latex,
Cyberskin,
Jelly
Glass.
Wood
Or a combination of the above.

Thus to obtain a different effect, a flexible head could be replaced by a head of a different material such as glass or metal. If the heads and handle member are formed of different materials, the two separate ends of the combination can be used for separate effects merely by reversing the arrangement.

One or both the head and the handle may be ribbed or otherwise textured to yet further this change of effect obtained by reversing the orientation of the device.

When intended to be used with a harness for wearing of the device on the person of the user, the handle member can act as an adapter which include a flange at one end for insertion into the separate harness.

This invention relates to a sex toy of the type which can form a stationary dildo or a vibratory member with a penetrative head portion. The unique invention provides many different effects to the various types of attachments. In the sex toy industry there has never been an interlocking or interchangeable toy.

The arrangement herein provides a detachable/interchangeable and Interlocking Sex Toy which can be connected using different connecting methods as follows:

Clip Style

A unique interlocking design where the handle and the head (detachable/interchangeable head) interlock with clips.

The head (detachable/interchangeable Head) is slotted and has a collar with two open attachment points. The handle has an extension that works like a channel system. It has a collar with two clips that interlock into the attachment points on the detachable/interchangeable head. When releasing the detachable/interchangeable head from the handle there is a "two point head release mechanism" that you press to eject the handle from the head.

Twist and Turn Style

A very effective interlocking method that uses a pin and track locking system.

The head (detachable/interchangeable head) is slotted with a two pin attachment collar. The handle has an extension that works like a channel that the head slides down. The channel on the handle has a collar with slots that the pins from the head align with. The pins when aligned will interlock into the handle when turned. Two pins are required on opposite sides of the collar on the head to ensure proper fastening.

Threaded Style

Uses a screw and nut traditional method to interlock.

The handle member can have a threaded rod that screws into the head (detachable/interchangeable head). The head acts like a nut that is threaded onto the rod creating an effective traditional interlocking

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
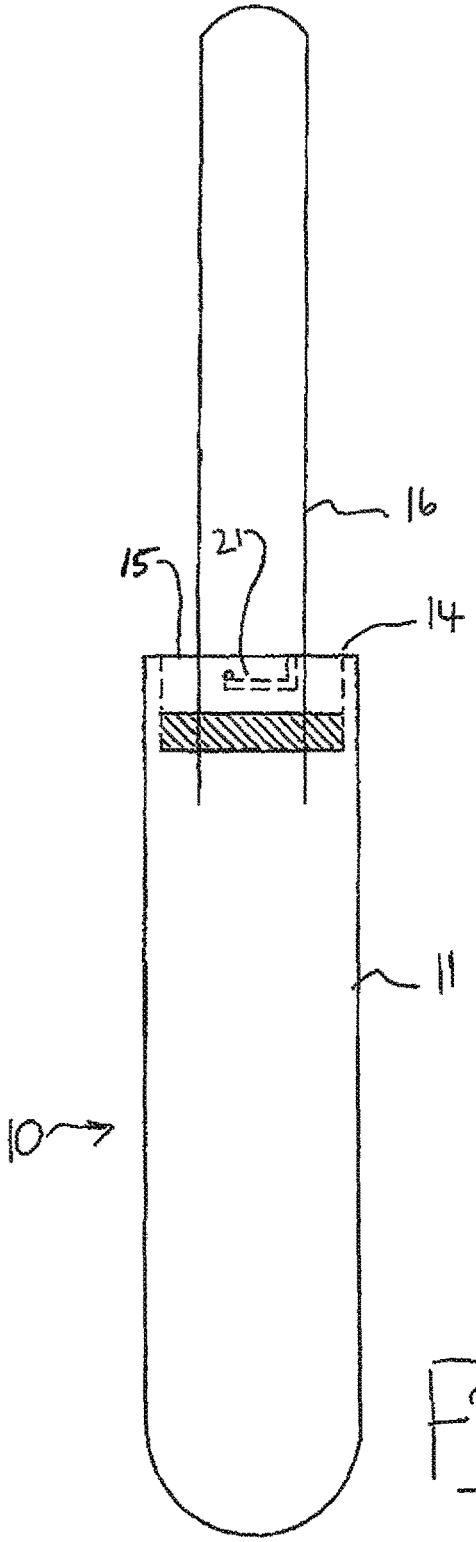
FIG. 1 is a cross-sectional view through a first embodiment of a handle member for use with a plurality of separate heads which forms a stationary dildo head and there are provided separate heads shown in FIGS. 9 to 13 of different sizes and designs for mounting on the handle member for attachment to the handle member by a bayonet type fitting.

In each of the embodiments the device comprises a handle member 10 forming a generally cylindrical body 11 which can be manually grasped and held by placing the fingers around the body. The body includes an elongate insertion portion 16 at one end of the body which can be inserted into a hollow interior of a respective selected one of the various heads for attachment at a coupling at the bottom of the insertion portion 16. The elongate insertion portion 16 acts as a connector portion. Where the arrangement provides a vibrating motor, both the handle member and the core will therefore vibrate.

A plurality of separate penetrative head portions 17 shown in the further FIGS. 9 to 13 each have an outer generally cylindrical body 13 forming a penetrative portion with a receptacle 12 therein for engaging onto the elongate insertion portion 16 with the generally cylindrical penetrative portion 13 arranged to extend forwardly from the handle member 10. The insertion portion 16 forms a shaft extending longitudinally along the head portion along a sufficient extent thereof to locate the head portion on the handle member and to transfer the vibration.

The head portions are arranged such that each can be engaged separately onto the handle member when selected.

The handle member has cylindrical portion 11 which forms a continuation of the cylindrical penetrative portion 13 of the head portion when attached so that when mated the head portion and handle member are of the same diameter and meet at a common line 14, 14A where a shoulder 15 of the head portion butts and end 18 of the handle member surrounding the elongate insertion portion 16.

Different styles of the head portion can be provided for mating with the single handle member to provide different effects.

Figure 9:
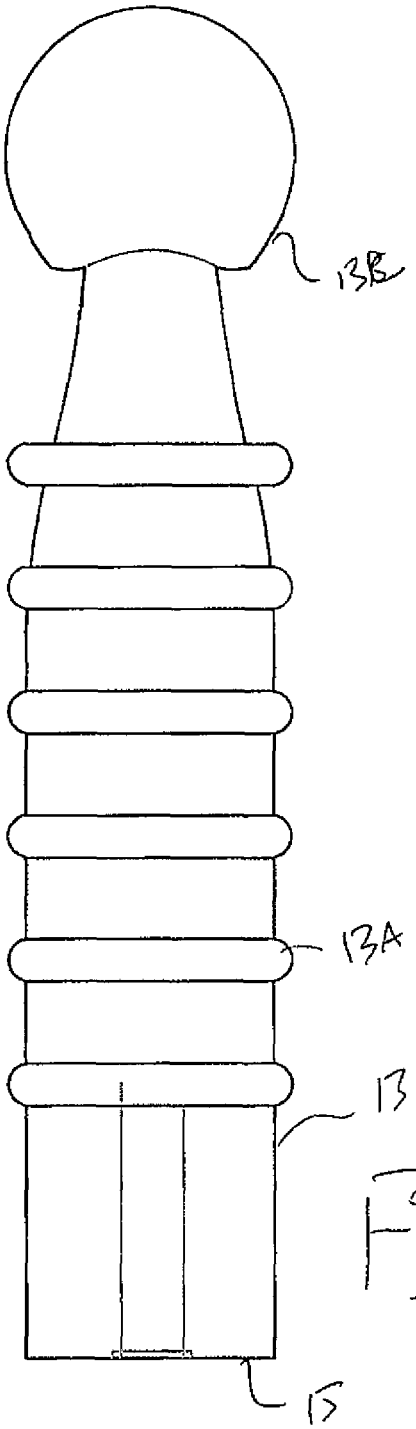
FIG. 9 is a side elevational view through a second embodiment of head for attachment to a handle member where the head has a complex shape of different diameters and mounts on the handle member using a screw type fastener.

Thus at least one of the head portions shown in FIG. 9 has peripheral ribs 13A surrounding the cylindrical main body 13.

Thus at least one of the head portions has peripheral protrusions 13B extending outwardly from the cylindrical main body 13.

Figure 10:
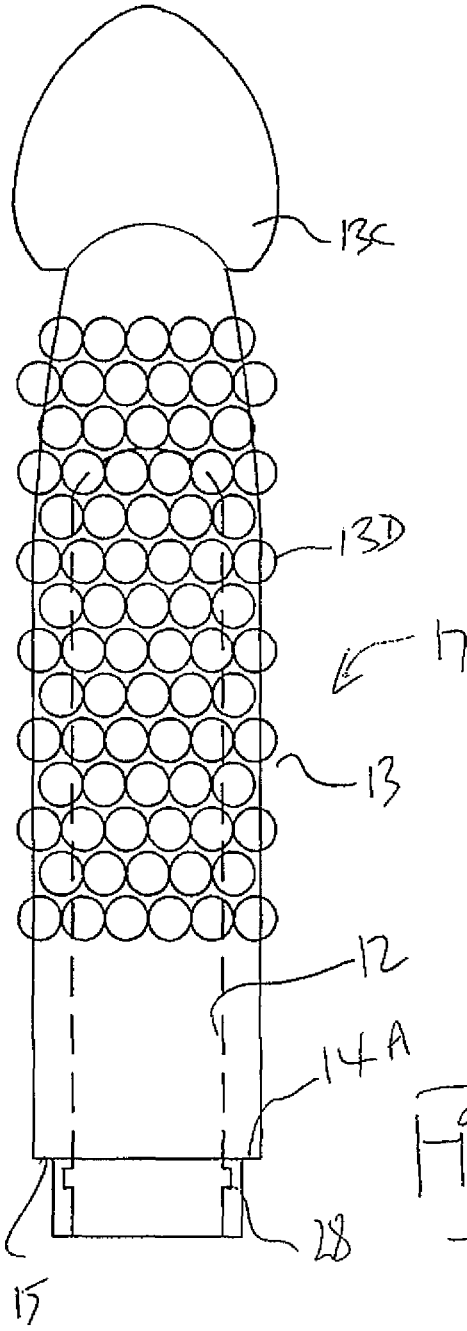
FIG. 10 is a side elevational view through a third embodiment of head for attachment to a handle member where the head has a complex shape of projecting nubs and mounts on the handle member using a snap type fastener of the type shown in FIGS. 3, 5 and 6.

Thus at least one of the head portions FIGS. 9 and 10 has a raised head 13C of larger diameter than the cylindrical portion.

Thus at least one of the head portions FIG. 10 has raised nubs or balls 13D arranged around the periphery of the cylindrical portion.

Thus the different head portions may have different diameters so as to provide portions larger in diameter than the handle member.

In FIG. 1 the handle member forms a stationary member for a dildo and uses a bayonet fastening 21 defining a pair of opposed slots each for receiving a pin 21A (FIG. 13) on the head for mounting the selected head onto the handle member. In FIG. 1 the elongate insertion portion 16 that also vibrates inserts into the hollow interior of the body of FIG. 13 to provide increased stiffness.

Figure 2:
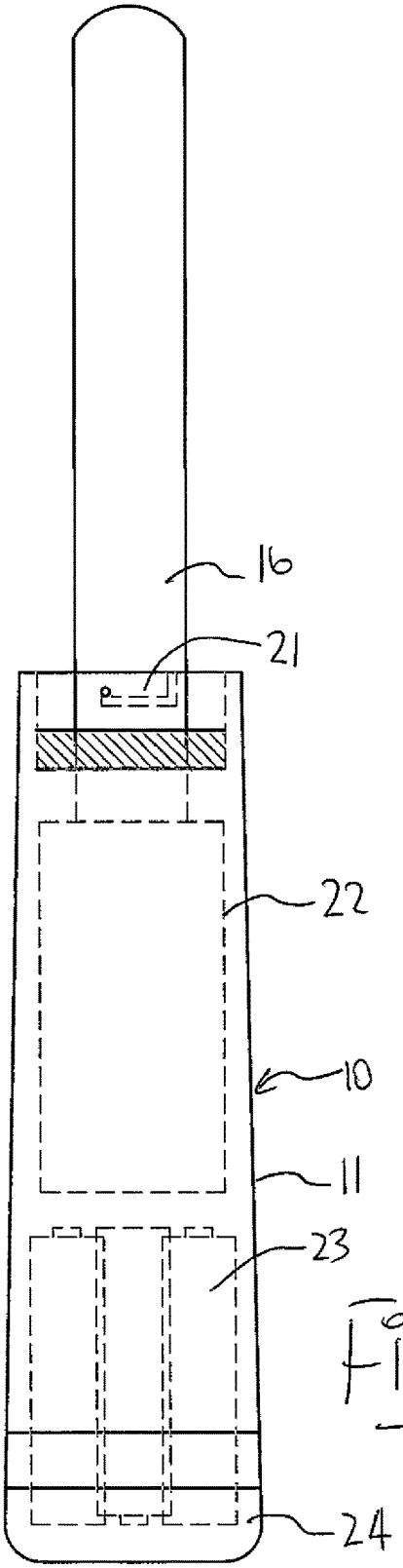
FIG. 2 is a cross-sectional view through a second embodiment where the handle member forms a vibrator head and includes a motor and there are provided separate heads shown in FIGS. 9 to 13 of different sizes and designs for mounting on the handle member for attachment to the handle member by a bayonet type fitting.

In FIG. 2 the handle member includes a vibratory motor 22 operable by a turn knob switch 24 defined by an end portion of the handle which rotates relative to a main body of the handle to initiate and control speed and/or amplitude as driven by a battery 23. FIG. 2 uses the same bayonet fitting 21.

Figure 3:
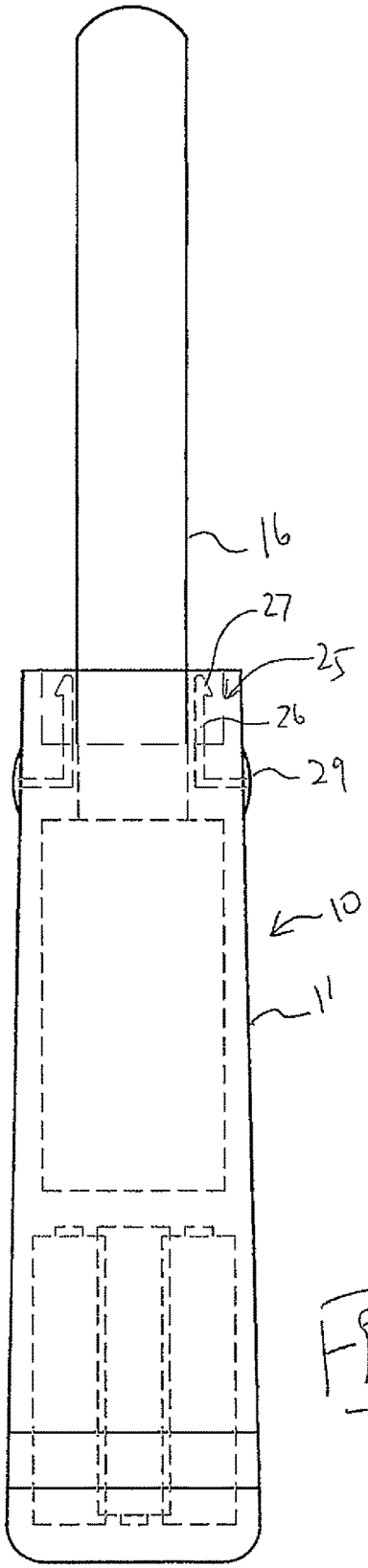
FIG. 3 is a cross-sectional view through a third embodiment where the handle member forms a vibrator head and includes a motor for use with separate heads shown in FIGS. 9 to 13 of different sizes and designs for mounting on the handle member for attachment to the handle member by a snap coupling type fitting.

In FIG. 3 there is provided a fastener 25 to hold the receptacle onto the elongate insertion portion which forms a snap connection by two spring fingers 26 with latch portions 27 engaging into a recess 28 in the head (FIG. 10). In FIG. 3 the spring fingers 26 of the fastener include a manually operable release 29 which presses on the finger to release the latch from the recess 28.

Figure 4:
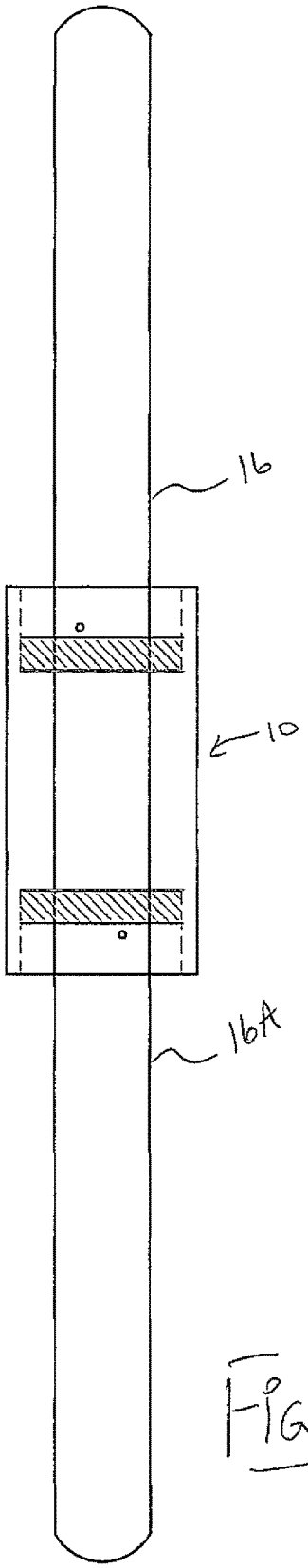
FIG. 4 is a cross-sectional view through a fourth embodiment similar to FIG. 1 where the stationary type handle member carries two connectors for carrying a separate head at each end.
Figure 5:
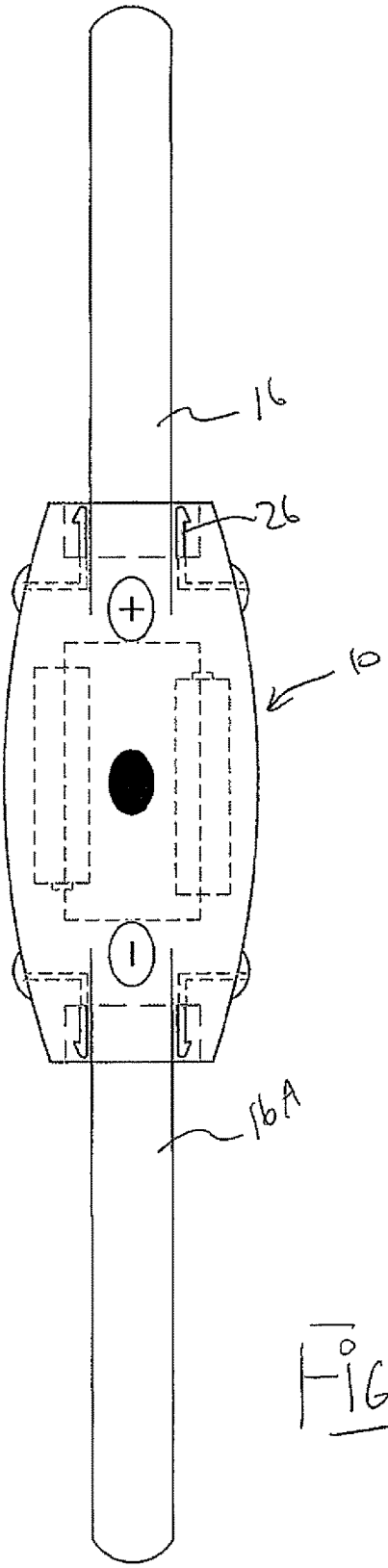
FIG. 5 is a cross-sectional view through a fifth embodiment similar to FIG. 2 where the vibrator type handle member carries two connectors for carrying a separate head at each end.

In FIGS. 4 and 5, the handle member forms a central cylindrical portion 10 with the elongate insertion portion 16, 16A at each end of the portion 10 so that the handle can receive two opposed heads selected from the group of heads. The figures show the different modes of fastening. Also in an alternative arrangement (not shown) can be provided in which the central handle portion can fasten to two heads as shown in FIG. 4 or 5 but without the provision of the stiffening core 16, 16A.

Figure 6:
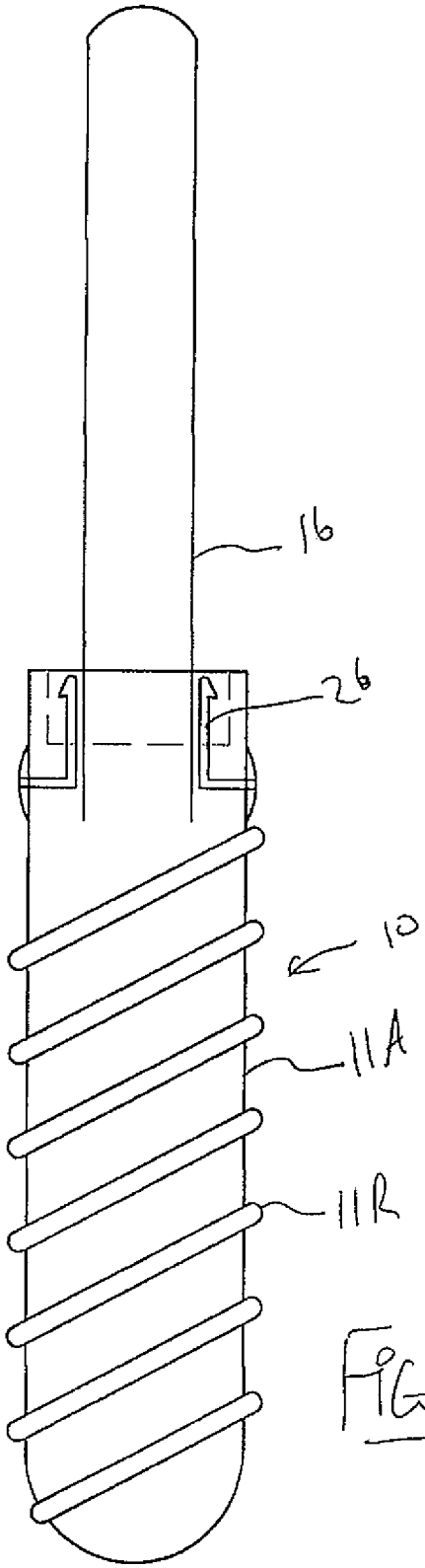
FIG. 6 is a cross-sectional view through a sixth embodiment similar to FIG. 1 where the dildo type handle member carries a ribbed handle and uses the snap type fastening system.
Figure 7:
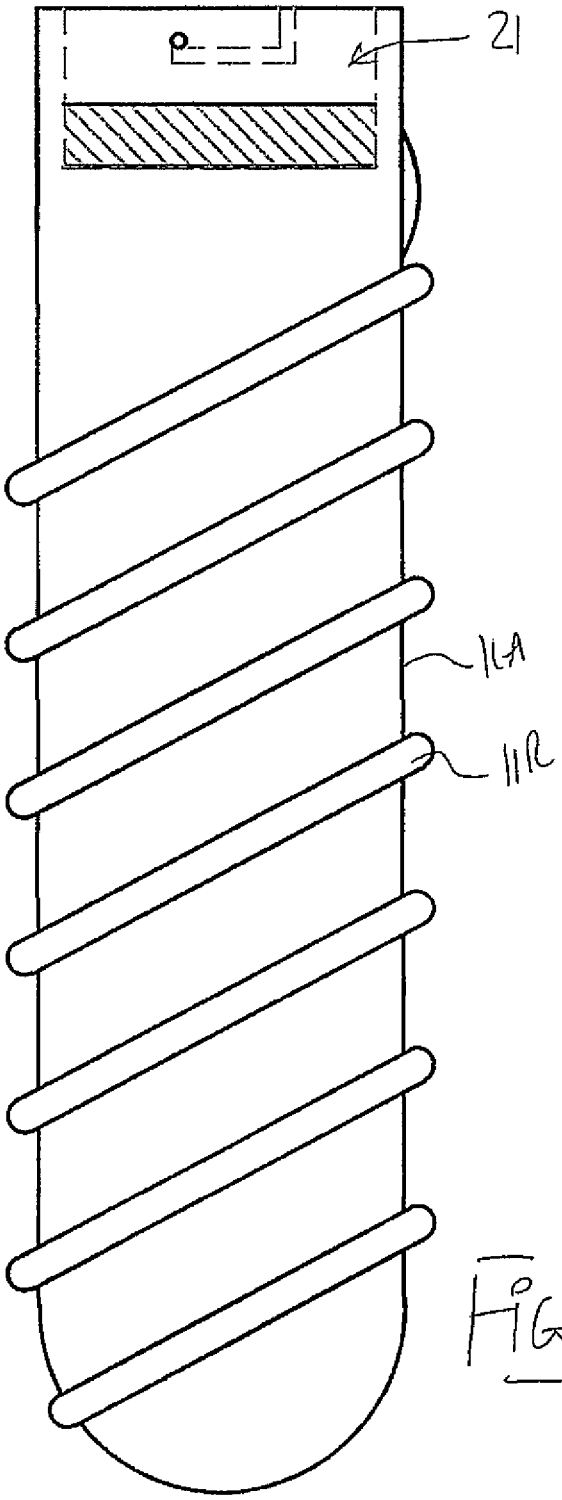
FIG. 7 is a cross-sectional view through a sixth embodiment similar to FIG. 1 where the dildo type handle member carries a ribbed handle and uses the bayonet type fastening system.

In FIGS. 6 and 7, the handle member 10 is modified to include ribs 11R around the cylindrical handle 11A. These can match or be different from the shape of the selected head to be attached. FIG. 6 uses the snap fastening fingers 26 and FIG. 7 uses the bayonet fitting 21. FIG. 6 includes the elongate insertion portion defining the core 16 and FIG. 7 excludes the core which vibrates as well.

Figure 8:
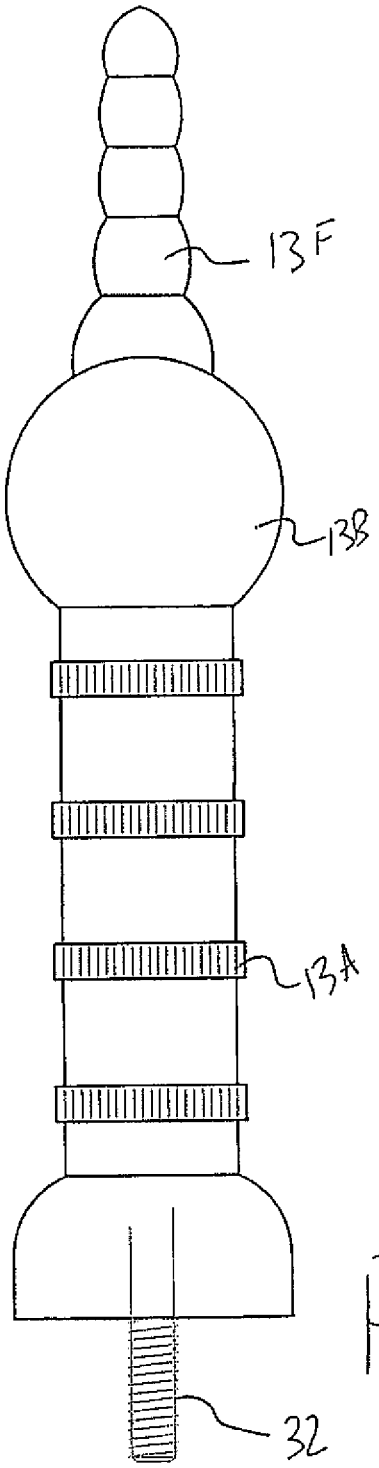
FIG. 8 is a side elevational view through a first embodiment of handle member for attachment to a head where the handle member has a complex shape of different diameters and mounts to the head using a screw type fastener.

In FIG. 8 is shown an arrangement where the fastening of the head to the handle member as shown is carried out by a threaded screw fastener 32 which engages into a threaded receptacle in the head. The handle in FIG. 8 including the bands or shaping components can be manufactured in plastic or in metal. The shape of the handle member in FIG. 8 includes a raised protrusion 13B and an upper tip 13F of reduced diameter which is solid, stiff or firm in view of the use of the plastics or metal material. When in metal, a chrome plating or stainless steel finish can be used. This shows only one example of many different designs which can be generated of different diameters, lengths and flexibility with various protrusions at different positions along the length so as to generate a set of heads with different effects for selection by the users depending on their current wishes. The arrangement of FIG. 8 can use different materials in the construction for example a metal core or body and an exterior layer of glass, plastic, latex, rubber, silicone or wood. The arrangements herein can also use stainless steel or chrome plating as an exterior finish at any of the locations thereon.

FIG. 9 also uses the screw thread attachment and shows a protrusion or larger head 13C at the tip.

FIG. 10 uses the snap type fastener attachment and shows a protrusion or larger head 13C at the tip together with a cluster of projections 13D on the shaft 13.

Figure 11:
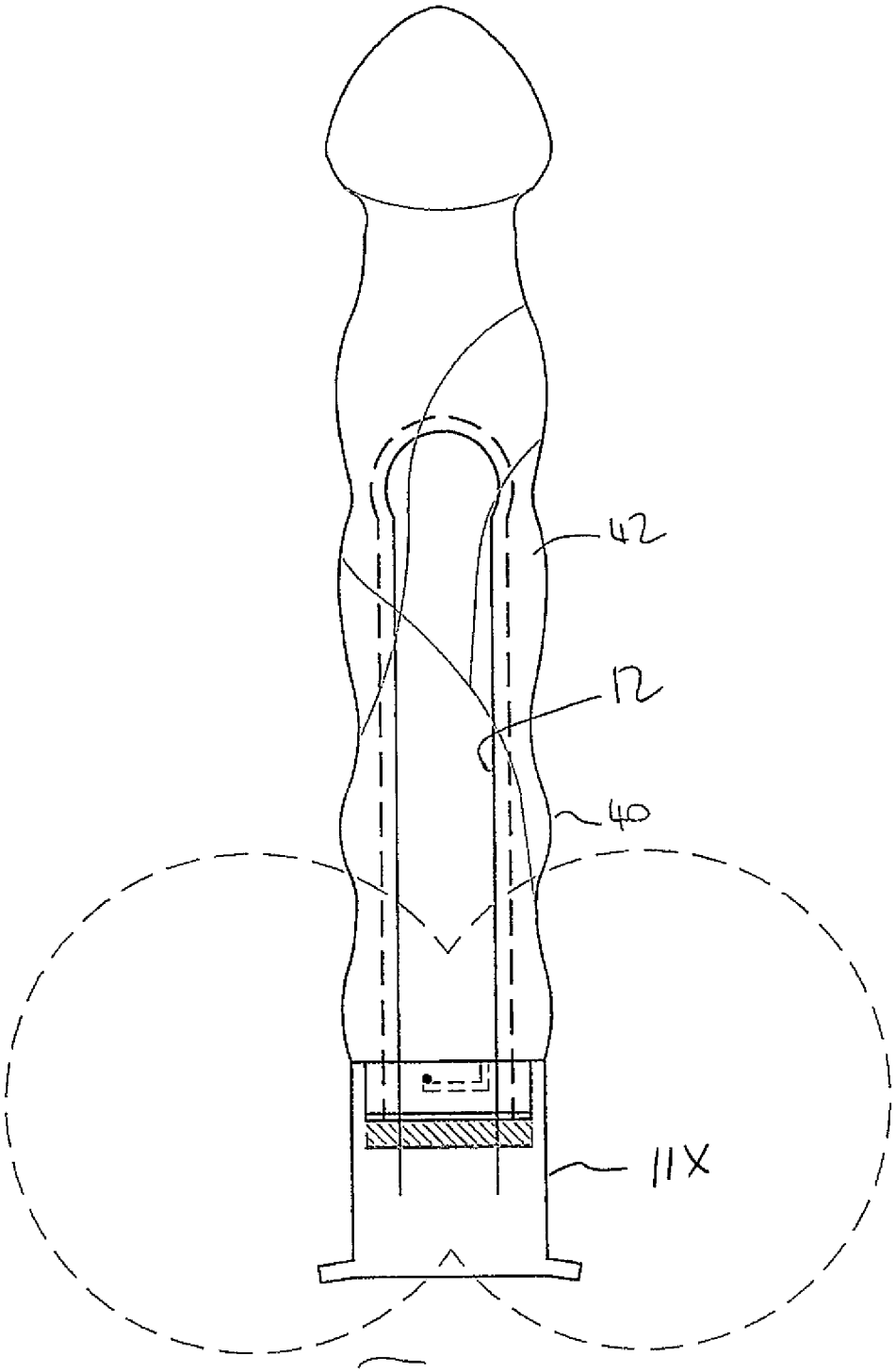
FIG. 11 is a partly broken side elevational view through a fourth embodiment of head attached to a handle member using the bayonet fitting.
Figure 14:
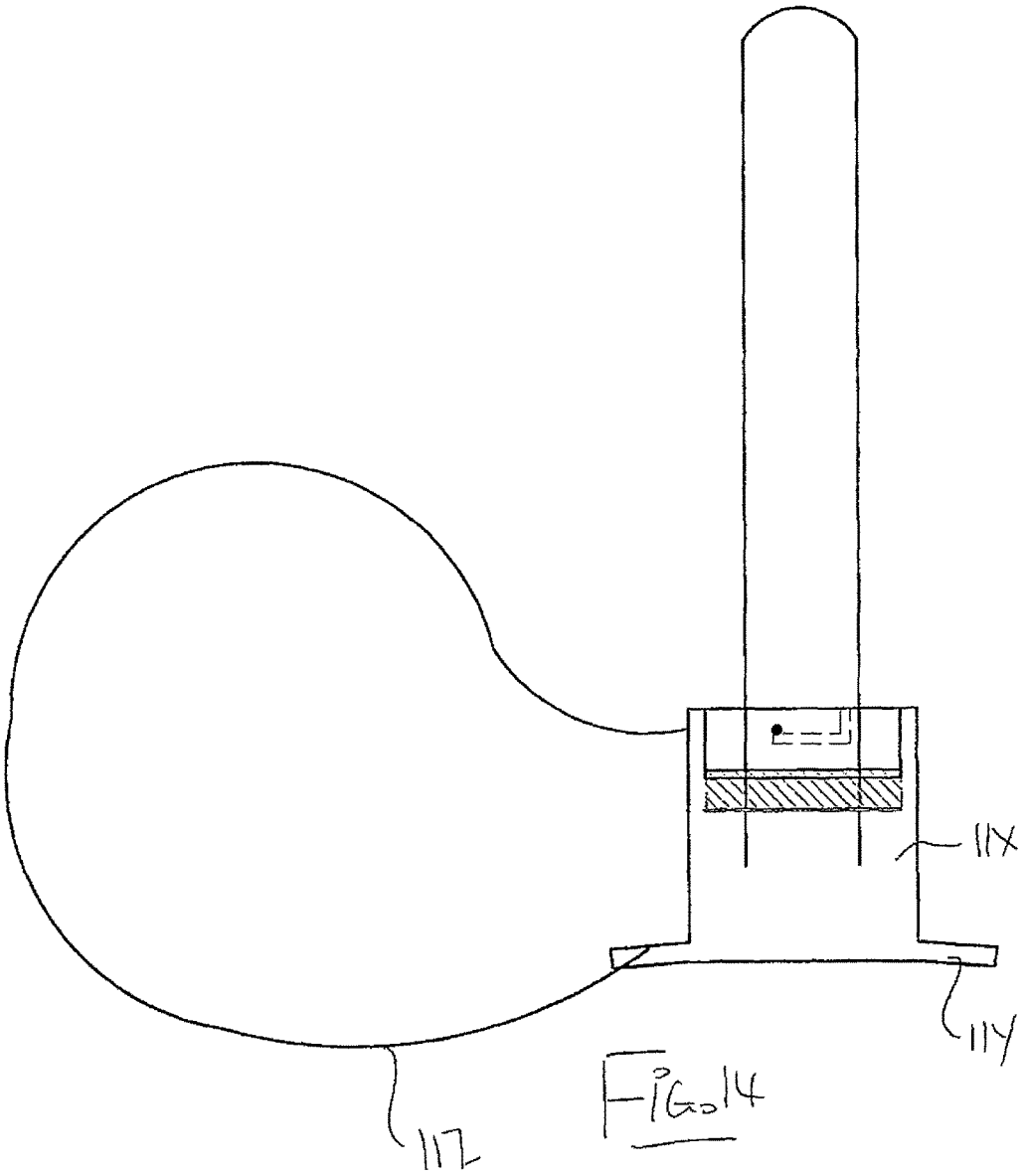
FIG. 14 is a side elevational view through a further embodiment of handle member for receiving the heads where the handle member forms a base with a flange for mounting on a separate harness for attachment to the body of the wearer.

FIGS. 11 and 14 shows a short adapter 11X with a bottom flange 11Y allowing the adapter to sit against the body of the user with the flange 11Y arranged to be received within a receptacle of a conventional separate harness so as to attach the handle member to the body of the wearer. The bulbous members 11Z at or adjacent the flange 11Y show the option of including a simulation of testicles to be formed on or carried on the base member or adapter of this or any other one of the handles if required.

Figure 12:
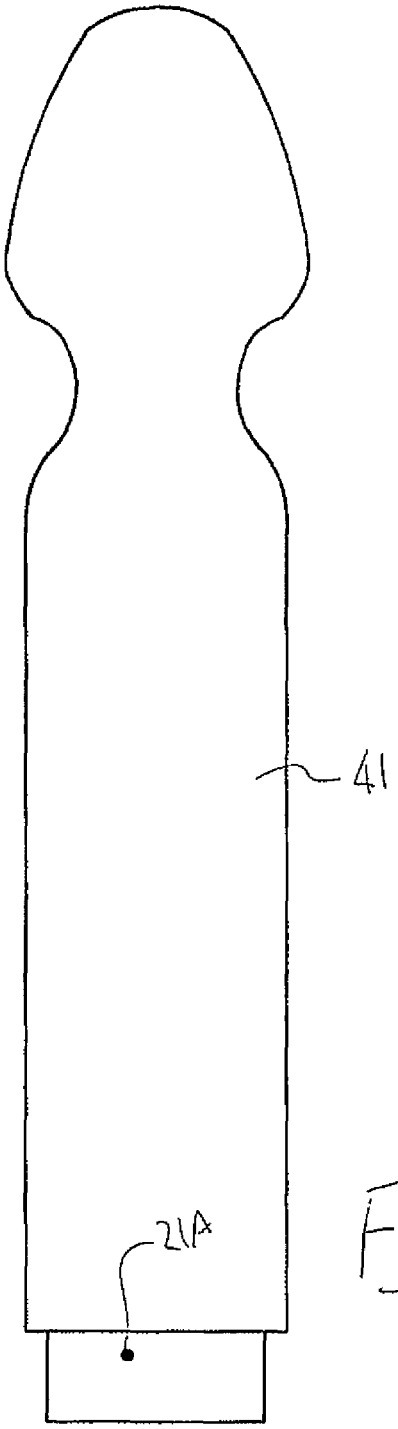
FIG. 12 is a side elevational view through a fifth embodiment of head for attachment to a handle member where the head has a simple basic shape which can be provided in different dimensions.
Figure 13:
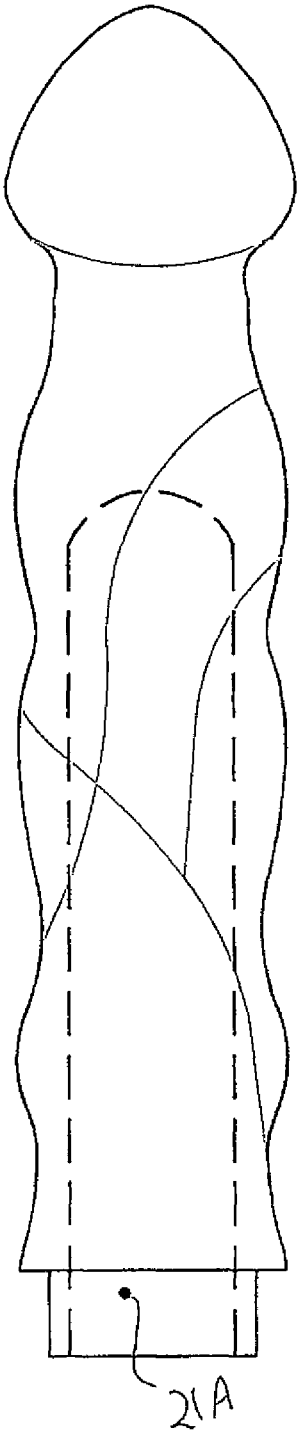
FIG. 13 is a side elevational view through a sixth embodiment of head for attachment to a handle member where the head has a simple basic shape with an undulating periphery which can be provided in different dimensions.

FIGS. 12 and 13 each show a simple basic shape using the projections 21A of the bayonet fastening system.

Figure 15:
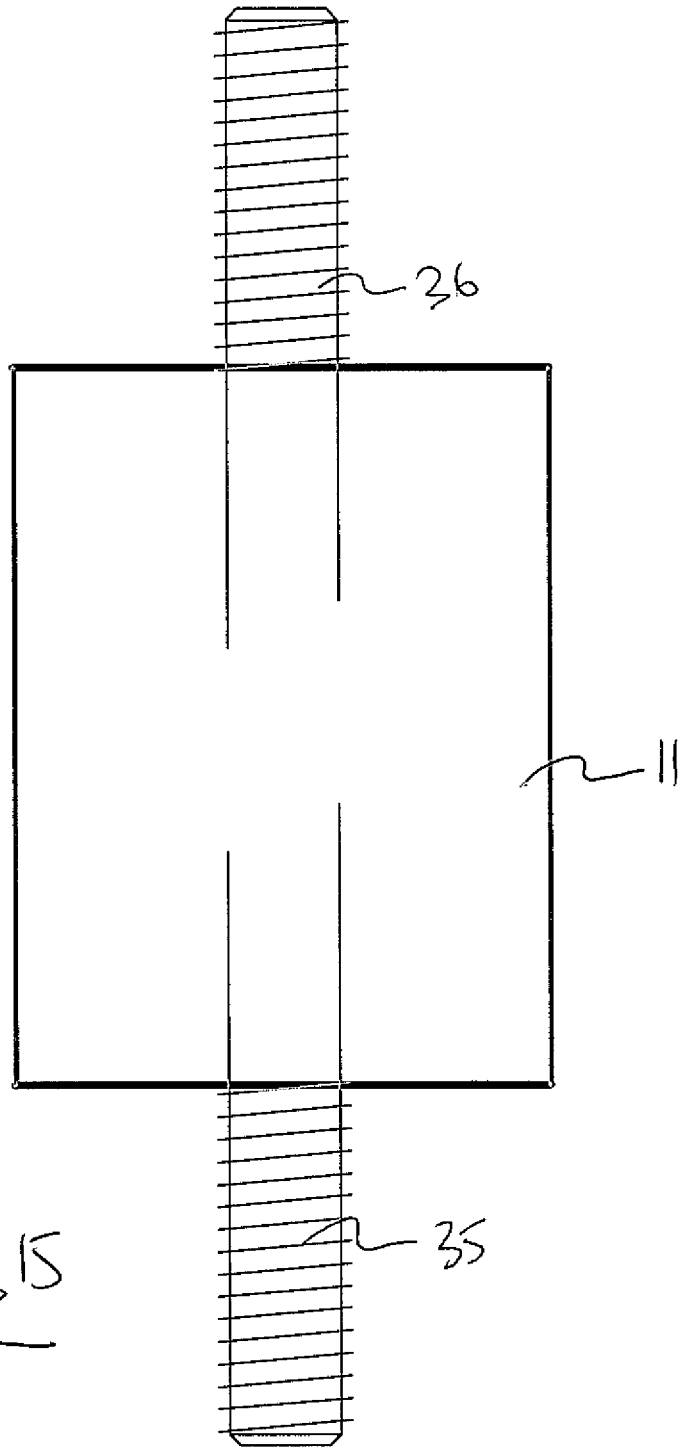
FIG. 15 is a side elevational view through a further embodiment of handle member for receiving two separate heads one at each end in the style of FIGS. 4 and 5 but using the screw type attachment of the heads.

FIG. 15 is a side elevational view through a further embodiment of handle member 11 for receiving two separate heads one at each end in the style of FIGS. 4 and 5 but using the screw type attachment 35, 36 of the heads.

Figure 16:
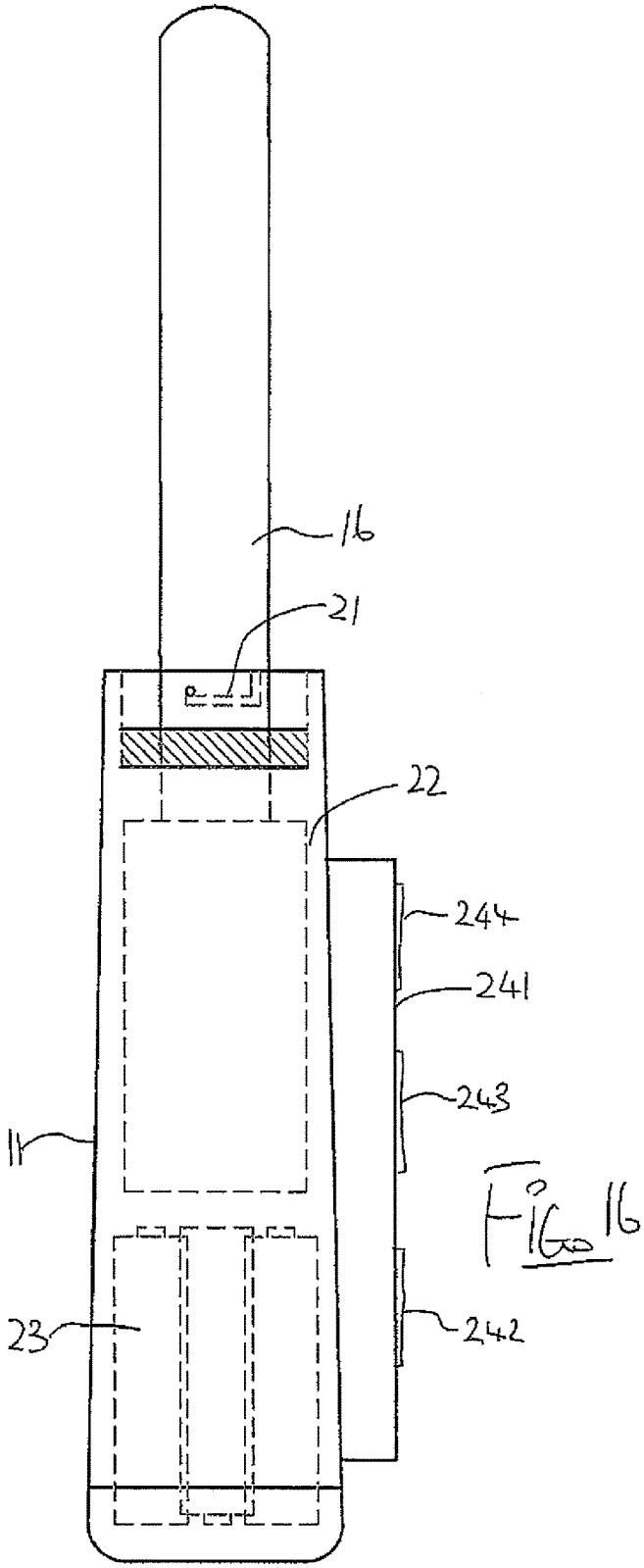
FIG. 16 is a side elevational view through a further embodiment of handle member similar to that of FIG. 2 where the controls are mounted on a side panel of the handle member.

FIG. 16 is a side elevational view through a further embodiment of handle member similar to that of FIG. 2 where an on/off control 242 and a separate control 243 for and speed and/or amplitude are mounted on a side panel 241 of the handle member and include an amplitude or speed display 244.

Each of the head portions is formed from a selected one of the materials listed herein to form a flexible outer surface 40 as shown in FIGS. 11 and 12. In FIG. 12 the whole of the head portion is formed wholly of the silicone material 41. In FIG. 11 an outer layer 42 only is molded from silicone of other soft flexible material.

The removable heads are "detachable/interchangeable", heads which are engaged separately. The whole purpose of the dildo and vibrator models is that they will have "detachable/interchangeable", heads that is the key selling feature. Also the "detachable/interchangeable", heads "interlock", together creating a safe, effective and durable connection which can snap together.

There are various/multiple detachable/interchangeable head options. Not just four head options for the dildo and the vibrator model.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A sex toy comprising:

a handle member forming a generally cylindrical handle body which can be manually grasped and held;

the handle member comprising a connector portion at least at one end of the handle body;

and a plurality of separate selectable penetrative head portions for engaging onto the connector portion of the handle member and each having a generally cylindrical penetrative portion arranged to extend forwardly from the handle member, the separate selectable head portions having different outside shapes and/or dimensions;

the separate selectable head portions being arranged such that each can be engaged separately onto the connector portion of the handle member when selected;

wherein the handle member comprises a releasable fastener at said at least one end of the handle body with a manually operable release;

wherein the connector portion of the handle member comprises an elongate stiffening core extending longitudinally and coaxially of the generally cylindrical handle body to a position beyond said at least one end of the handle body and the releasable fastener thereon;

the elongate stiffening core having a transverse dimension less than that of the handle body;

each of said separate selectable penetrative head portions including a hollow interior defining an elongate receptacle therein for engaging onto the stiffening core;

each of said separate selectable penetrative head portions including a connector thereon for releasably engaging the releasable fastener of the handle member.

2. The sex toy according to claim 1 wherein the handle body comprises a cylindrical portion which forms a continuation of the cylindrical penetrative portion of each of the separate selectable penetrative head portions when attached.

3. The sex toy according to claim 1 wherein at least one of the separate selectable head portions has peripheral ribs.

4. The sex toy according to claim 1 wherein at least one of the separate selectable head portions has peripheral protrusions.

5. The sex toy according to claim 1 wherein at least one of the separate selectable head portions has a raised head of larger diameter than the cylindrical penetrative portion.

6. The sex toy according to claim 1 wherein the handle member forms a stationary member for a dildo.

7. The sex toy according to claim 1 wherein at least one of said separate selectable penetrative head portions includes a flexible outer surface formed from a flexible material.

8. The sex toy according to claim 1 wherein at least one of said separate selectable penetrative head portions is formed wholly of a flexible material.

9. The sex toy according to claim 1 wherein said separate selectable penetrative head portions have different diameters.

10. The sex toy according to claim 1 wherein said separate selectable penetrative head portions have different lengths.

11. A sex toy comprising:

a handle member forming a handle body which can be manually grasped and held;

the handle member comprising a connector portion at least at one end of the handle body;

and a plurality of separate selectable penetrative head portions for engaging onto the connector portion of the handle member and each having a generally cylindrical penetrative portion arranged to extend forwardly from the handle member, the separate selectable head portions having different outside shapes and/or dimensions;

the separate selectable head portions being arranged such that each can be engaged separately onto the connector portion of the handle member when selected;

wherein the handle member comprises a releasable fastener at said at least one end of the handle body with a manually operable release;

wherein the connector portion of the handle member comprises an elongate stiffening core extending longitudinally and coaxially of the handle member to a position beyond said at least one end of the handle body and the releasable fastener thereon;

the elongate stiffening core having a transverse dimension less than that of the handle body;

each of said separate selectable penetrative head portions including a hollow interior defining an elongate receptacle therein for engaging onto the stiffening core;

each of said separate selectable penetrative head portions including a connector thereon for releasably engaging the releasable fastener of the handle member;

a vibration motor mounted in the handle member;

said elongate stiffening core extending longitudinally along each of said separate selectable penetrative head portions when selected to locate the selected head portion on the handle member and to transfer to the selected head portion a vibration from the vibration motor.

12. The sex toy according to claim 11 wherein the handle body comprises a cylindrical portion which forms a continuation of the cylindrical penetrative portion of each of the separate selectable penetrative head portions when attached.

13. The sex toy according to claim 11 wherein at least one of the separate selectable head portions has peripheral ribs.

14. The sex toy according to claim 11 wherein at least one of the separate selectable head portions has peripheral protrusions.

15. The sex toy according to claim 11 wherein at least one of the separate selectable head portions has a raised head of larger diameter than the cylindrical penetrative portion.

16. The sex toy according to claim 11 wherein at least one of said separate selectable penetrative head portions includes a flexible outer surface formed from a flexible material.

17. The sex toy according to claim 11 wherein at least one of said separate selectable penetrative head portions is formed wholly of a flexible material.

18. The sex toy according to claim 11 wherein said separate selectable penetrative head portions have different diameters.

19. The sex toy according to claim 11 wherein said separate selectable penetrative head portions have different lengths.

* * * * *